US010080938B2

(12) United States Patent
Klas

(10) Patent No.: US 10,080,938 B2
(45) Date of Patent: Sep. 25, 2018

(54) HEAD ATTIRE FOR GOLF ACCESSORIES

(71) Applicant: Natalie M. Klas, Fredonia, WI (US)

(72) Inventor: Natalie M. Klas, Fredonia, WI (US)

( * ) Notice: Subject to any disclaimer, the term of this patent is extended or adjusted under 35 U.S.C. 154(b) by 610 days.

(21) Appl. No.: 14/028,234

(22) Filed: Sep. 16, 2013

(65) Prior Publication Data

US 2015/0074869 A1 Mar. 19, 2015

(51) Int. Cl.

| | |
|---|---|
| ***A63B 57/20*** | (2015.01) |
| ***A42B 1/24*** | (2006.01) |
| ***A63B 57/30*** | (2015.01) |
| ***A63B 57/00*** | (2015.01) |

(52) U.S. Cl.

CPC ..... *A63B 57/203* (2015.10); *A42B 1/241* (2013.01); *A63B 57/0032* (2015.10); *A63B 57/207* (2015.10); *A63B 57/353* (2015.10); *A63B 2209/08* (2013.01)

(58) Field of Classification Search

CPC ..... A42B 1/24; A42B 1/004; A42B 1/241; A42B 1/247; A42B 1/248

USPC ..... 2/209.13, 209.14, 209.4, 452, 10

See application file for complete search history.

(56) References Cited

U.S. PATENT DOCUMENTS

| | | | | | |
|---|---|---|---|---|---|
| 2,865,027 | A | * | 12/1958 | Shapiro | 2/195.3 |
| 5,092,667 | A | * | 3/1992 | Bagley | 351/156 |
| 5,117,510 | A | * | 6/1992 | Broussard et al. | 2/209.3 |
| D396,738 | S | * | 8/1998 | Territo | D2/866 |
| 5,894,604 | A | * | 4/1999 | Crabb et al. | 2/209.13 |
| 6,110,080 | A | * | 8/2000 | Niv | 482/105 |
| 6,163,889 | A | * | 12/2000 | Tate | 2/209.13 |
| 6,247,177 | B1 | * | 6/2001 | Hayes | 2/12 |
| 6,298,495 | B1 | * | 10/2001 | Totani | 2/209.13 |
| 6,308,336 | B1 | * | 10/2001 | Stephenson et al. | 2/209.13 |
| 6,644,807 | B1 | * | 11/2003 | Hood | 351/155 |
| 6,647,554 | B1 | * | 11/2003 | Yan | 2/209.13 |
| 6,671,885 | B2 | * | 1/2004 | Viggiano | 2/209.13 |
| 6,792,619 | B1 | * | 9/2004 | Morris et al. | 2/10 |
| 6,966,851 | B1 | * | 11/2005 | England et al. | 473/406 |
| 7,003,809 | B1 | * | 2/2006 | Gordon | 2/209.13 |
| 7,275,270 | B2 | * | 10/2007 | Cotutsca | 2/209.13 |
| D571,982 | S | * | 7/2008 | Kirby | D2/882 |
| 7,484,845 | B2 | * | 2/2009 | Douglas | 351/155 |
| D601,330 | S | * | 10/2009 | Bishop | D2/882 |
| D607,627 | S | * | 1/2010 | Kowalczuk | D2/876 |
| D615,733 | S | * | 5/2010 | Chappell | D2/886 |
| 7,979,921 | B2 | * | 7/2011 | Cotutsca | 2/209.13 |
| 8,813,265 | B2 | * | 8/2014 | Schwantes | 2/209.13 |
| D718,021 | S | * | 11/2014 | Werczberger | D2/882 |

(Continued)

*Primary Examiner* — Shaun R Hurley
*Assistant Examiner* — Bao-Thieu L Nguyen
(74) *Attorney, Agent, or Firm* — Ziolkowski Patent Solutions Group, SC

(57) ABSTRACT

A head attire for golf accessories is an apparatus that is used to organize and carry small objects upon a player's head during a round of golf. The apparatus includes a bill, a head band, and an at least one tee pocket. The head band supports and holds the apparatus on the player's head, and the bill shields the player's eyes from the sun. The at least one tee pocket is integrated into the head band so that a golf tee can be carried by the apparatus similar to a person tucking a pen/pencil behind their ear. The tee pocket includes a slit opening and a pocket bag. The slit opening traverses into the pocket bag adjacent to the bill. The pocket bag is the actual means to carry the golf tee and is located within the head band.

14 Claims, 11 Drawing Sheets

(56) References Cited

U.S. PATENT DOCUMENTS

| | | | | |
|---|---|---|---|---|
| 2002/0023287 | A1* | 2/2002 | Badillo et al. | 2/209.13 |
| 2003/0024033 | A1* | 2/2003 | Viggiano | 2/209.13 |
| 2005/0050613 | A1* | 3/2005 | Legg et al. | 2/209.13 |
| 2006/0143799 | A1* | 7/2006 | Young | 2/209.13 |
| 2006/0152671 | A1* | 7/2006 | Risso et al. | 351/155 |
| 2007/0028360 | A1* | 2/2007 | Cotutsca | 2/209.13 |
| 2007/0220656 | A1* | 9/2007 | Cotutsca | 2/171 |
| 2008/0163407 | A1* | 7/2008 | Gardner | 2/209.13 |
| 2009/0210995 | A1* | 8/2009 | Kwon et al. | 2/209.13 |
| 2011/0030124 | A1* | 2/2011 | Zhen | 2/209.13 |
| 2011/0314580 | A1* | 12/2011 | Vach | 2/10 |
| 2014/0033397 | A1* | 2/2014 | Schwantes | 2/209.13 |
| 2014/0063443 | A1* | 3/2014 | Berger | 351/155 |

* cited by examiner

HEAD ATTIRE FOR GOLF ACCESSORIES

FIELD OF THE INVENTION

The present invention generally relates to golfing headwear that is used to organize and carry other golf accessories.

BACKGROUND OF THE INVENTION

Traditionally, a golf tee is normally used for only the first stroke of each hole and will need to be used for the first stroke of the next hole. A golf tee is usually an elongated stake with a bulged head to hold a golf ball above the ground. A golf tee is relatively small in size and can be lost while playing the other strokes of a hole. A ball marker is used is save the spot of a player's golf ball while the golf ball is cleaned by the player or if the golf ball is in the path of an opposing player's golf ball. A ball marker usually has a flat circular shape so that the ball marker can mimic the area occupied by the golf ball on the golf course. A ball marker is relatively small in size and can be lost while the ball marker is not being used by the player. Therefore, the objective of the present invention is to provide a casual golfing headwear that is able to carry and organize small golf accessories during a round of golf. The present invention provides a specific area and a specific means to carry each golf accessory, which prevents a player from misplacing and losing such small objects.

DETAILED DESCRIPTIONS OF THE INVENTION

All illustrations of the drawings are for the purpose of describing selected versions of the present invention and are not intended to limit the scope of the present invention.

Figure 1:
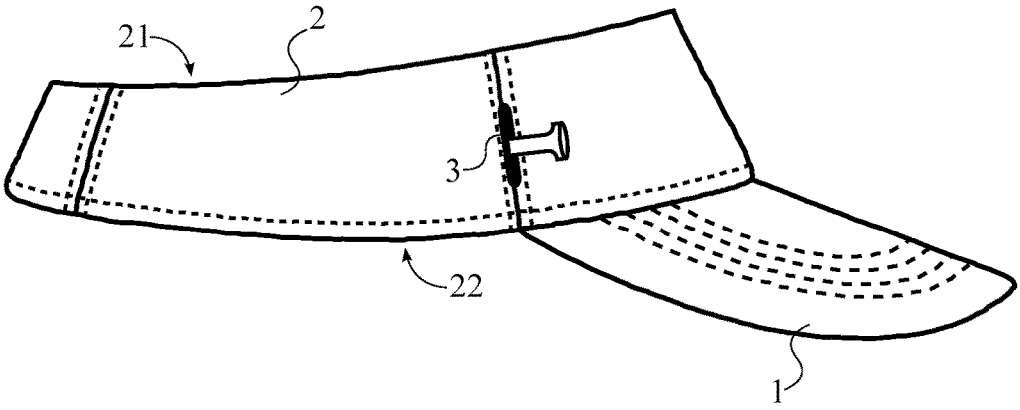
FIG. 1 is a side view of the present invention.
Figure 2:
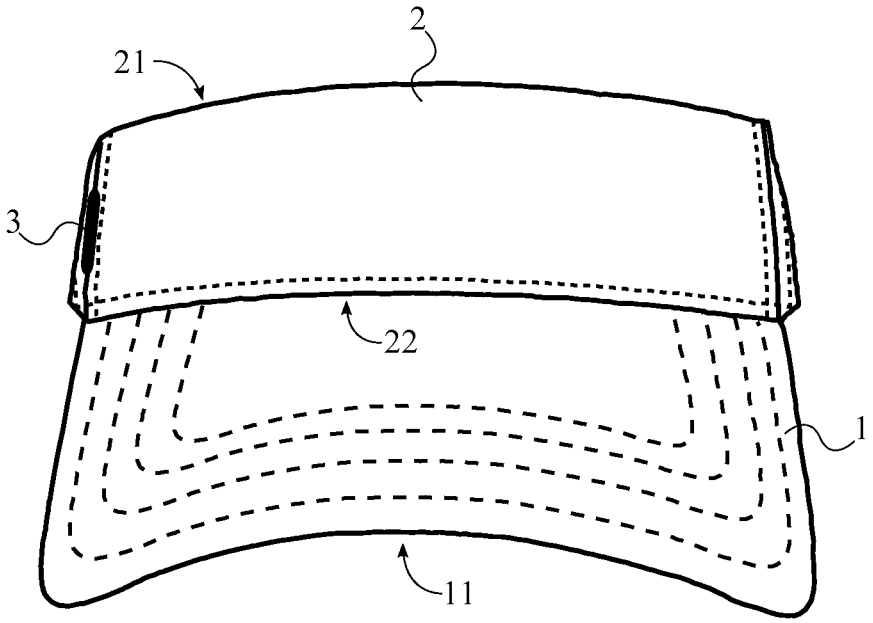
FIG. 2 is a front view of the present invention.
Figure 17:
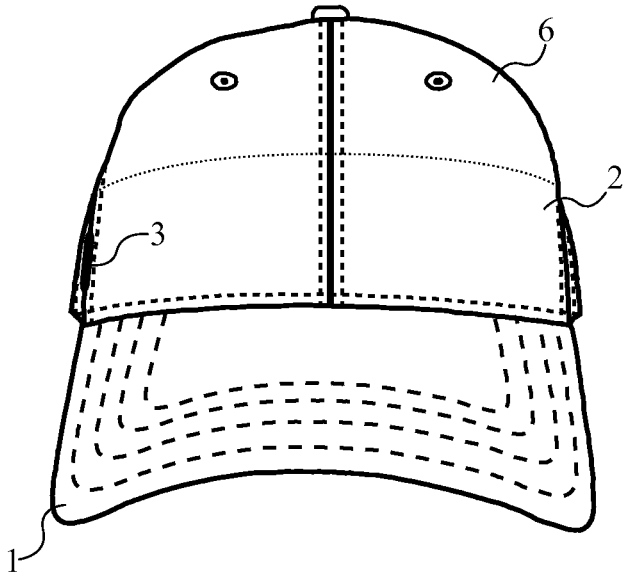
FIG. 17 is a front view of the present invention, which is configured with a crown.
Figure 18:
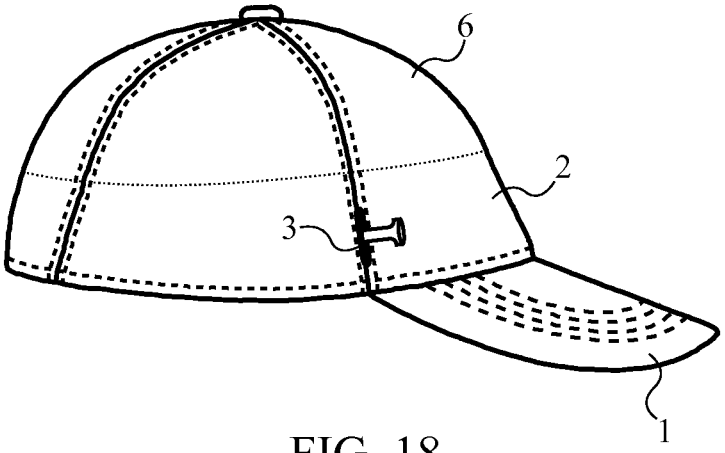
FIG. 18 is a side view of the present invention, which is configured with a crown.

As can be seen in FIGS. 1 and 2, the present invention is a head attire that is used to collectively carry small golf accessories. The present invention provides a specific hidden area to hold each of the small golf accessories, which prevents a user from losing these small golf accessories. The present invention mainly comprises a bill 1, a headband 2, and an at least one tee pocket 3. The headband 2 is used to firmly secure the present invention onto a user's head. The headband 2 is also used as the structural base to connect the other components of the present invention together. Moreover, the bill 1 is connected around the bottom edge 22 of the headband 2. While wearing the present invention, the bill 1 should be oriented in order to cast a shadow over the user's face so that the user's face is protected from the sun. The at least one tee pocket 3 allows the user to carry one or more golf accessories on the present invention. More specifically, the at least one tee pocket 3 is designed to discreetly carry a tee on the user's head much like how a person tucks a pen/pencil behind their ear. Thus, the at least one tee pocket 3 needs to be integrated into the headband 2 so that a golf tee can be efficiently and effectively carried by the present invention. In some embodiments, the present invention further comprises a crown 6 that is used to cover the top of a user's head, which is shown in FIGS. 17 and 18. The crown 6 is circumferentially connected to the top edge 21 of the headband 2 in order to provide a snug fit for the present invention around the user's head.

Figure 3:
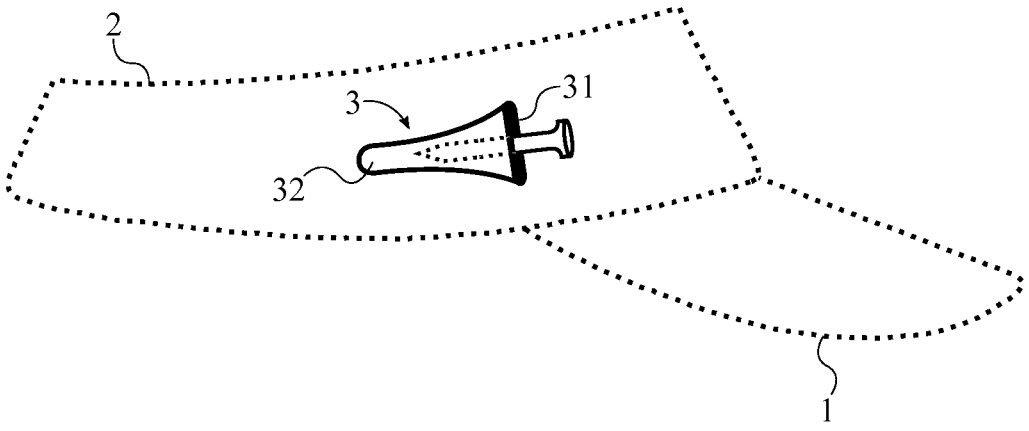
FIG. 3 is a side view of the internal components of the present invention.

The at least one tee pocket 3 is designed to conveniently hold a golf tee on the side of the user's head for easy accessibility without compromising the aesthetic appeal of the present invention. Each of the at least one tee pocket 3 comprises a slit opening 31 and a pocket bag 32, which are shown in FIG. 3. A golf tee is traverses through the slit opening 31 and into the pocket bag 32, which braces and holds the golf tee in place on the present invention. The pocket bag 32 is located within the headband 2 so that the headband 2 can be used to enclose and further support the golf tee within the pocket bag 32. The slit opening 31 traverses into the pocket bag 32 and, thus, allows a golf tee to enter the pocket bag 32 from outside the headband 2. The pocket bag 32 extends away from the bill 1 so that the golf tee does not occupy the same portion of the headband 2 that is connected to the bill 1. This portion of the headband 2 is more rigid and curved because of its connection to the bill 1, and, thus, the golf tee should be supported by a more flexible portion of the headband 2. The pocket bag 32 also tapers away from the slit opening 31 so that the pocket bag 32 more tightly sleeves the golf tee as the golf tee traverses further into the pocket bag 32. In the preferred embodiment of the present invention, the headband 2 comprises a plurality of construction pieces, which are serially connected together and are circularly configured to form the headband 2. The plurality of construction pieces is double layered so that the pocket bag 32 is located in between the two layers of a construction piece. Also in the preferred embodiment, the slit opening 31 is located in between the connection of two construction pieces as an efficient means to incorporate the at least one pocket into the headband 2.

Figure 4:
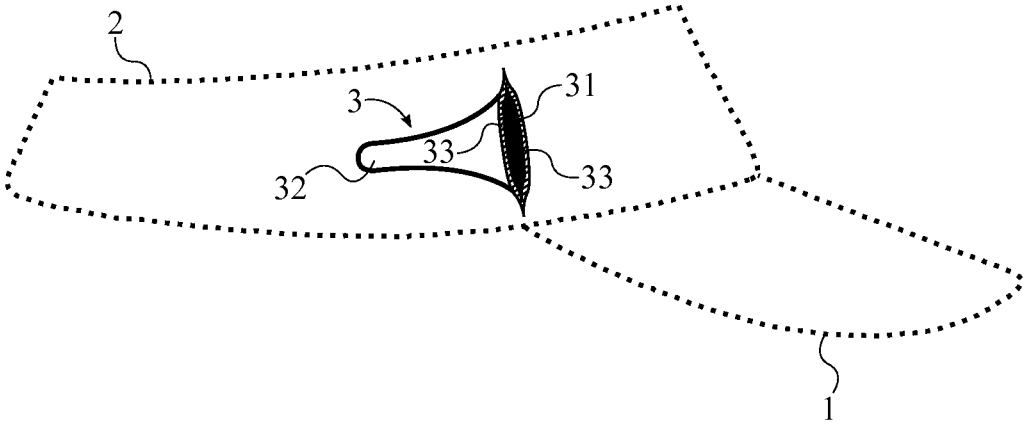
FIG. 4 is a side view of the internal components of the present invention and highlights the pair of welts.
Figure 5:
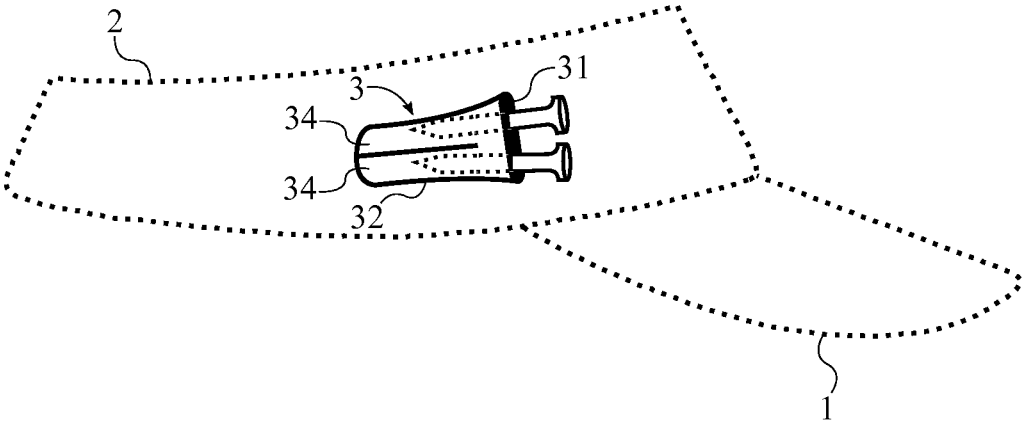
FIG. 5 is a side view of the internal components of the present invention and highlights the plurality of compartments.
Figure 6:
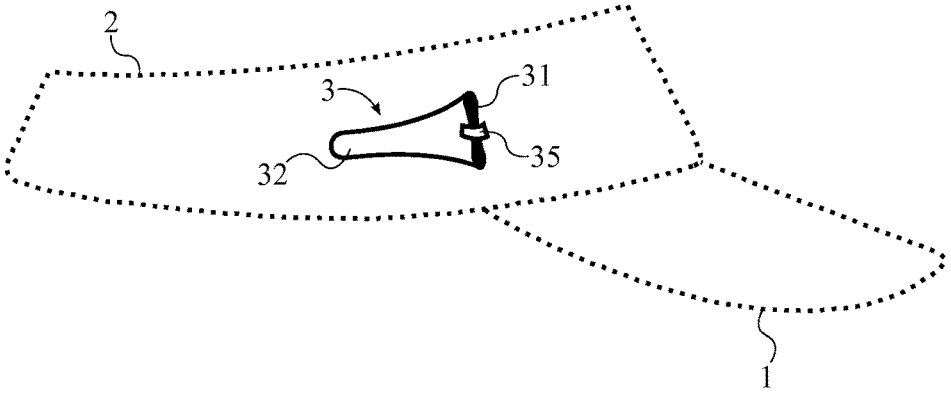
FIG. 6 is a side view of the internal components of the present invention and highlights the fastener.
Figure 7:
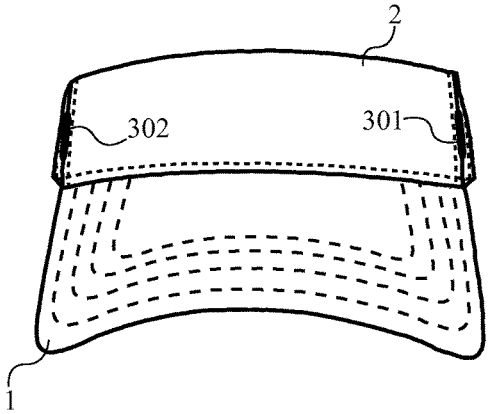
FIG. 7 is a front view of the present invention, which is configured with a left tee pocket and a right tee pocket.
Figure 8:
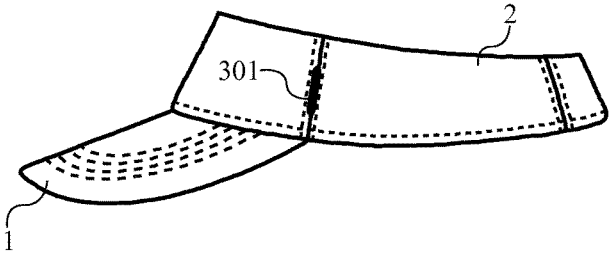
FIG. 8 is a left view of the present invention, which is configured with a left tee pocket and a right tee pocket.
Figure 9:
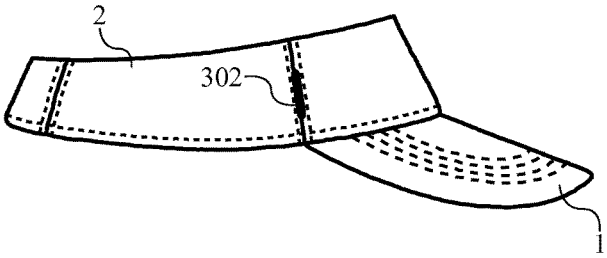
FIG. 9 is a right view of the present invention, which is configured with a left tee pocket and a right tee pocket.

In some embodiments of the present invention, each of the at least one tee pocket 3 further comprises a pair of welts 33, which are stitched reinforcements as can be seen in FIG. 4. The pair of welts 33 is positioned opposite to each other so that the slit opening 31 can be delineated by the pair of welts 33. The pair of welts 33 also allows the user to easily feel around the headband 2 in order to find the slit opening 31. In some embodiments, each of the at least one tee pocket 3 further comprises a plurality of compartments 34, which can be used to separate multiple golf tees being held within the at least one tee pocket 3 as can be seen in FIG. 5. The plurality of compartments 34 is stitched into and along the pocket bag 32 so that the slit opening 31 traverses into the plurality of compartments 34, and, consequently, the multiple golf tees can enter and be held by the at least one tee pocket 3. In some embodiments, each of the at least one tee pocket 3 further comprises a fastener 35, which is used to close off the slit opening 31 while the at least one tee pocket 3 is not being occupied a golf tee. Thus, the fastener 35 is attached across the slit opening 31, which is shown in FIG. 6. The fastener 35 can be, but is not limited to, a hook and loop fastener or a snap. In one embodiment, the present invention is designed to accommodate both left-handed and right-handed players, which is shown in FIGS. 7, 8, and 9. Thus, the at least one tee pocket 3 includes a left tee pocket 301 and a right tee pocket 302. The left tee pocket 301 is positioned adjacent to the bill 1, and the right tee pocket 302 is positioned adjacent to the bill 1 opposite to the left tee pocket 301, which places the left tee pocket 301 above one temple of the user's head and places the right tee pocket 302 above the other temple of the user's head. This allows a left-handed player to more naturally insert and withdraw a golf tee from the left tee pocket 301. This also allows a right-handed player to more naturally insert and withdraw a golf tee from the right tee pocket 302.

Figure 10:
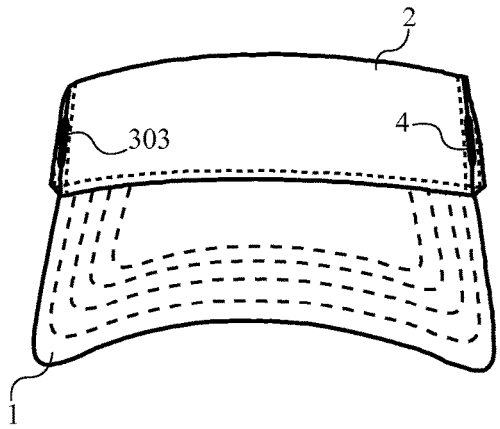
FIG. 10 is a front view of the present invention, which is configured with a single tee pocket and a marker pocket.
Figure 11:
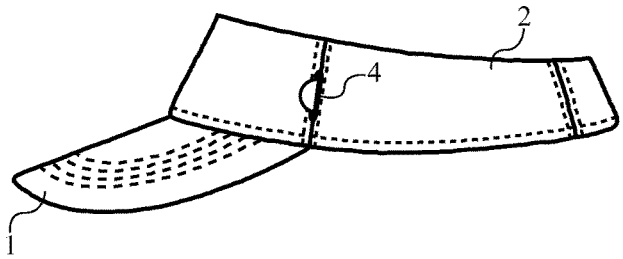
FIG. 11 is a left view of the present invention, which is configured with a single tee pocket and a marker pocket.
Figure 12:
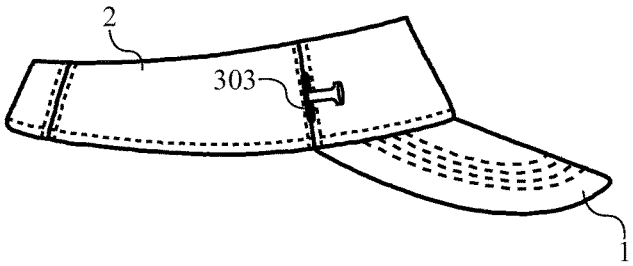
FIG. 12 is a right view of the present invention, which is configured with a single tee pocket and a marker pocket.
Figure 13:
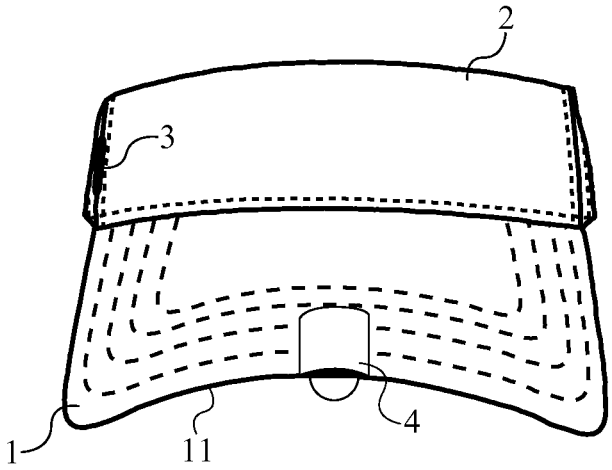
FIG. 13 is a front view of the present invention, which is configured with a marker pocket positioned on the bill.
Figure 14:
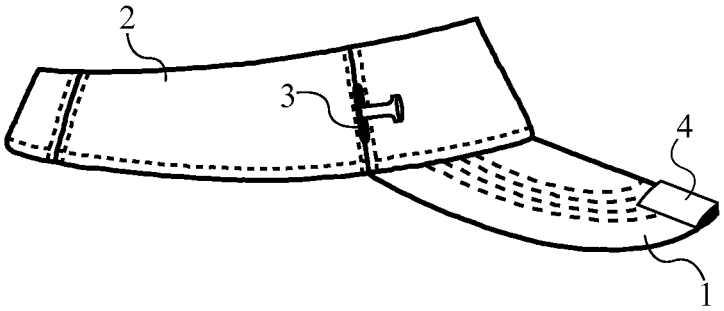
FIG. 14 is a side view of the present invention, which is configured with a marker pocket positioned on the bill.
Figure 15:
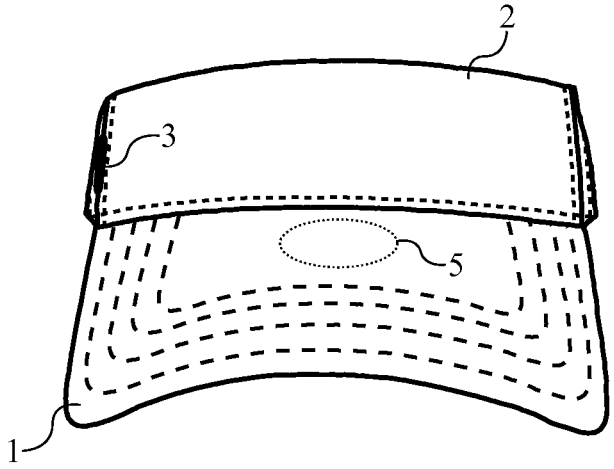
FIG. 15 is a front view of the present invention, which is configured with a marker magnet.
Figure 16:
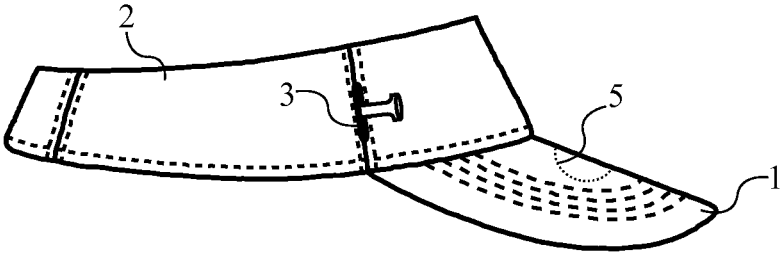
FIG. 16 is a side view of the present invention, which is configured with a marker magnet.

A ball marker is another small golf accessory that could be held by the present invention. Thus, the present invention could further comprise a marker pocket 4. In one embodiment of the present invention, the at least one tee pocket 3 is just a single tee pocket 303, and the marker pocket 4 is integrated into the headband 2 similar to the at least one tee pocket 3, which is shown in FIGS. 10, 11, and 12. In order to evenly space a golf tee and a ball marker being carried by the present invention, the single tee pocket 303 is positioned adjacent to the bill 1, and the marker pocket 4 is positioned adjacent to the bill 1 opposite to the single tee pocket 303. This would place the golf tee above one temple of the user's head and would place the ball marker above the other temple of the user's head, which keeps these golf accessories organized on the present invention and allows the user to be better able at find those golf accessories. In another embodiment, the marker pocket 4 is connected onto the bill 1 so that the ball marker is carried and held by the bill 1 of the present invention as can be seen in FIGS. 13 and 14. The marker pocket 4 is positioned adjacent to the distal edge 11 of the bill 1 so that the user can easily grasp the ball marker from the marker pocket 4 as the ball marker protrudes off the bill 1. In addition, the present invention could further comprise a marker magnet 5, which is used to magnetically hold a metal ball marker against the present invention. As can be seen in FIGS. 15 and 16, the marker magnet 5 is specifically positioned within the bill 1 so that the metal ball marker can be placed upon the bill 1 and held in place by the marker magnet 5.

Although the invention has been explained in relation to its preferred embodiment, it is to be understood that many other possible modifications and variations can be made without departing from the spirit and scope of the invention as hereinafter claimed.

What is claimed is:

1. A head attire for golf accessories comprises:
a headband;
a bill;
an at least one tee pocket;
said headband comprises a top edge and a bottom edge;
each of said at least one tee pocket comprises a pocket bag and a slit opening;
said bill being connected around a bottom edge of said headband;
said at least one tee pocket being integrated into said headband;
said pocket bag being located within said headband;
said slit opening being positioned adjacent to said bill;
said slit opening traversing into said pocket bag;
said pocket bag extending away from said bill;
said pocket bag being tapered away from said slit opening;
wherein each of said at least one tee pocket comprises a plurality of compartments, with said slit opening traversing into said plurality of compartments and said plurality of compartments being stitched into and along said pocket bag.

2. The head attire for golf accessories as claimed in claim 1 comprises:
each of said at least one tee pocket further comprises a pair of welts;
said pair of welts being positioned opposite to each other across said slit opening; and
said slit opening being delineated by said pair of welts.

3. The head attire for golf accessories as claimed in claim 1 comprises:
said at least one tee pocket being a left tee pocket and a right tee pocket;
said left tee pocket being positioned adjacent to said bill; and
said right tee pocket being positioned adjacent to said bill opposite said left tee pocket.

4. The head attire for golf accessories as claimed in claim 1 comprises:
a marker pocket;
said marker pocket being integrated into said headband;
said at least one tee pocket being a single tee pocket;
said single tee pocket being positioned adjacent to said bill; and
said marker pocket being positioned adjacent to said bill opposite to said single tee pocket.

5. The head attire for golf accessories as claimed in claim 1 comprises:
a marker pocket;
said marker pocket being connected onto said bill; and
said marker pocket being positioned adjacent to a distal edge of said bill.

6. The head attire for golf accessories as claimed in claim 1 comprises:
a marker magnet; and
said marker magnet being positioned within said bill.

7. The head attire for golf accessories as claimed in claim 1 comprises:
each of said at least one tee pocket further comprises a fastener; and
said fastener being attached across said slit opening.

8. The head attire for golf accessories as claimed in claim 1 comprises:

a crown; and said crown being circumferentially connected to said top edge of said headband.

9. A head attire for golf accessories comprises:

a headband;

a bill;

an at least one tee pocket;

said headband comprises a top edge and a bottom edge;

each of said at least one tee pocket comprises a pocket bag and a slit opening;

said bill being connected around a bottom edge of said headband;

said at least one tee pocket being integrated into said headband;

said pocket bag being located within said headband;

said slit opening being positioned adjacent to said bill;

said slit opening traversing into said pocket bag;

said pocket bag extending away from said bill;

said pocket bag being tapered away from said slit opening;

a marker pocket;

said marker pocket being integrated into said headband;

said at least one tee pocket being a single tee pocket;

said single tee pocket being positioned adjacent to said bill;

said marker pocket being positioned adjacent to said bill opposite to said single tee pocket;

wherein each of said at least one tee pocket further comprises a pair of welts said pair of welts being positioned opposite to each across said slit opening such that said slit opening is delineated by said pair of welts; and wherein each of said at least one tee pocket further comprises a plurality of compartments, with said slit opening traversing into said plurality of compartments and said plurality of compartments being stitched into and along said pocket bag.

10. The head attire for golf accessories as claimed in claim 9 comprises:

a crown;

a marker magnet;

each of said at least one tee pocket further comprises a fastener;

said crown being circumferentially connected to said top edge of said headband;

said fastener being attached across said slit opening; and said marker magnet being positioned within said bill.

11. A head attire for golf accessories comprises:

a headband;

a bill;

an at least one tee pocket;

said headband comprises a top edge and a bottom edge;

each of said at least one tee pocket comprises a pocket bag and a slit opening;

said bill being connected around a bottom edge of said headband;

said at least one tee pocket being integrated into said headband;

said pocket bag being located within said headband;

said slit opening being positioned adjacent to said bill;

said slit opening traversing into said pocket bag;

said pocket bag extending away from said bill;

said pocket bag being tapered away from said slit opening;

said at least one tee pocket being a left tee pocket and a right tee pocket;

said left tee pocket being positioned adjacent to said bill; and said right tee pocket being positioned adjacent to said bill opposite said left tee pocket;

wherein each of said at least one tee pocket further comprises a pair of welts, said pair of welts being positioned opposite to each across said slit opening such that said slit opening is delineated by said pair of welts; and wherein each of said at least one tee pocket further comprises a plurality of compartments, with said slit opening traversing into said plurality of compartments and said plurality of compartments being stitched into and along said pocket bag.

12. The head attire for golf accessories as claimed in claim 11 comprises:

a marker pocket;

said marker pocket being connected onto said bill; and said marker pocket being positioned adjacent to a distal edge of said bill.

13. The head attire for golf accessories as claimed in claim 11 comprises:

a marker magnet; and said marker magnet being positioned within said bill.

14. The head attire for golf accessories as claimed in claim 11 comprises:

a crown;

a marker magnet;

each of said at least one tee pocket further comprises a fastener;

said crown being circumferentially connected to said top edge of said headband;

said fastener being attached across said slit opening; and said market magnet being positioned within said bill.

* * * * *